US007300201B2

(12) United States Patent
Man

(10) Patent No.: US 7,300,201 B2
(45) Date of Patent: Nov. 27, 2007

(54) WRISTWATCH AND COUPLING ASSEMBLY FOR RELEASABLY JOINING A WRISTWATCH CASE TO A WRISTBAND

(75) Inventor: Wong Yu Man, New Territories (HK)

(73) Assignee: Skagen Designs Ltd., Reno, NV (US)

( * ) Notice: Subject to any disclaimer, the term of this patent is extended or adjusted under 35 U.S.C. 154(b) by 85 days.

(21) Appl. No.: 11/070,135

(22) Filed: Mar. 1, 2005

(65) Prior Publication Data

US 2006/0198248 A1 Sep. 7, 2006

(51) Int. Cl.
*G04B 37/00* (2006.01)
*A44B 11/25* (2006.01)

(52) U.S. Cl. ..... 368/282; 224/164; 24/265 WS

(58) Field of Classification Search ..... 24/265 WS; 368/281, 282; 224/176, 180, 177, 164
See application file for complete search history.

(56) References Cited

U.S. PATENT DOCUMENTS 3,165,884 A * 1/1965 Gwinner et al. ..... 368/282
3,589,575 A * 6/1971 Axler ..... 24/265 WS
4,034,552 A 7/1977 Davidson
4,117,662 A 10/1978 van der Lely
4,149,662 A 4/1979 Ramaciere
4,178,751 A 12/1979 Liautaud
4,231,502 A * 11/1980 Meyerson ..... 224/177
4,414,719 A * 11/1983 Capolupo ..... 24/265 WS
4,432,655 A * 2/1984 Wollman ..... 368/282
4,539,736 A * 9/1985 Yokosuka ..... 24/644
4,575,833 A 3/1986 Bakhtiari
4,605,312 A * 8/1986 Sellier ..... 368/282
4,722,179 A * 2/1988 Tesch ..... 59/82
4,879,702 A 11/1989 Gardner
5,106,004 A * 4/1992 Nguyen ..... 224/163
5,168,281 A * 12/1992 Tokunaga ..... 343/718
5,168,480 A 12/1992 Dodier
5,341,552 A * 8/1994 Voumard ..... 29/896.33
5,425,007 A 6/1995 Walter et al.
D360,592 S * 7/1995 Wermekes ..... D10/32
6,758,594 B2 7/2004 Yang
2003/0099163 A1* 5/2003 Yang ..... 368/281
2005/0048804 A1* 3/2005 Henriet et al. ..... 439/37

* cited by examiner

*Primary Examiner*—Vit Miska
*Assistant Examiner*—Sean Kayes
(74) *Attorney, Agent, or Firm*—Abelman, Frayne & Schwab

(57) ABSTRACT

The new wristwatch includes a wristwatch case including top and bottom parts and a watch movement within the case, a wristband including top and bottom band segments, each band segment having a first end part for engagement to the case and an opposite end part for engagement to the other band segment, and top and bottom coupling assemblies for releasably connecting the top and bottom parts of the case respectively to the top and bottom band segments, wherein the top coupling assembly includes an upper projection extending from the case top part, a recess formed in the first end part of the top band segment, the upper projection having height, width and depth dimensions adapted to fit into the recess, whereby the upper projection is essentially totally encompassed by the recess and invisible therein, and screw means adapted to engage and releasably join the first end part of the top band segment and the case top part. The bottom coupling assembly is similar to the top coupling assembly.

9 Claims, 8 Drawing Sheets

FIG. 3
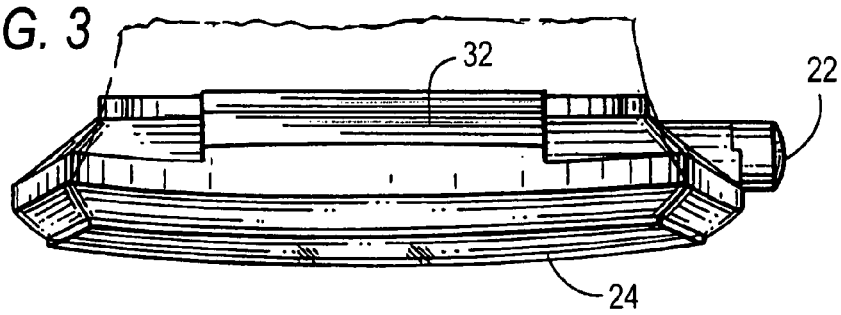
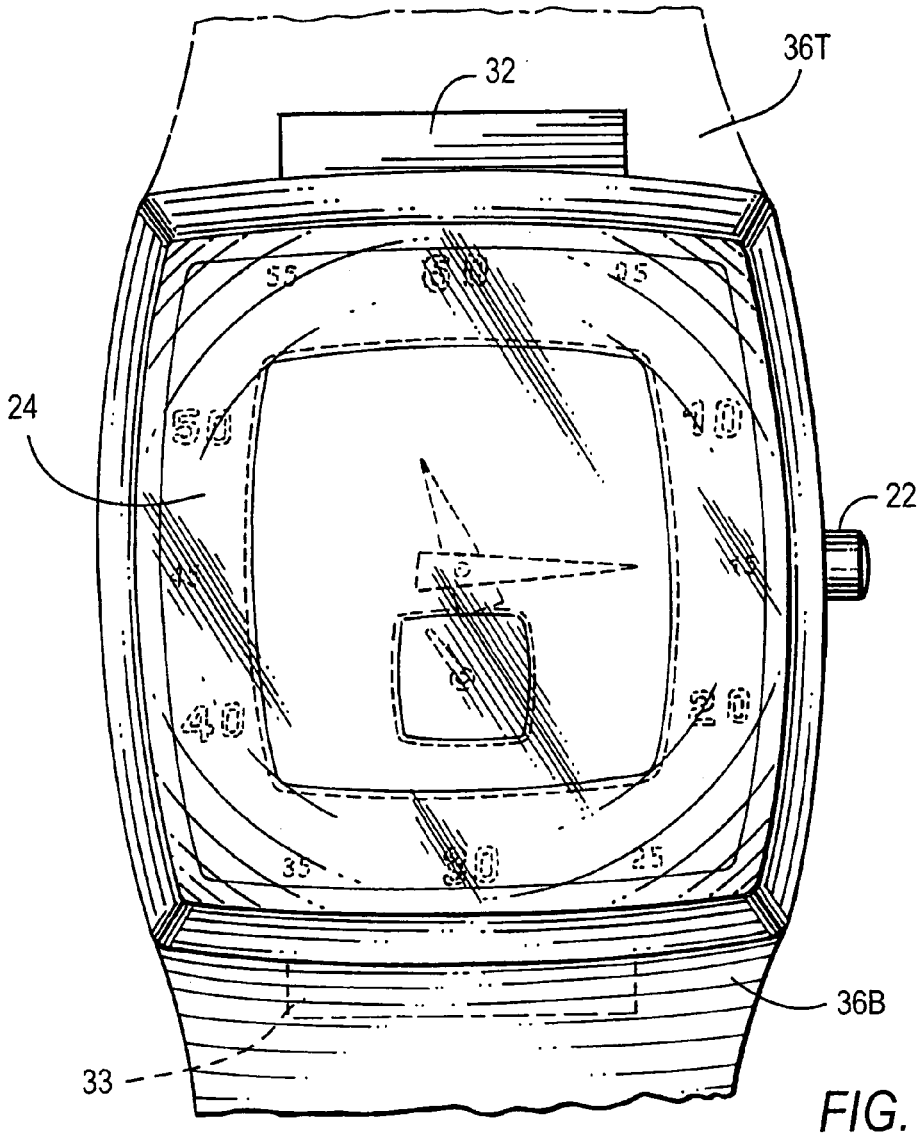
FIG. 4

FIG. 7
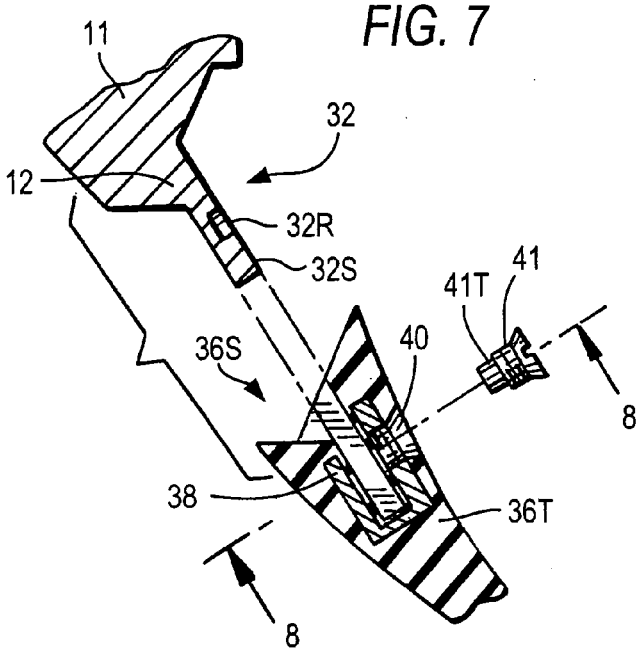
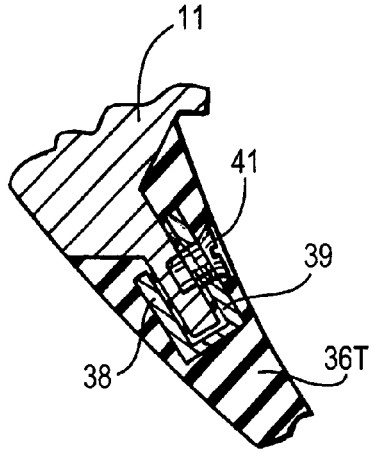
FIG. 9
FIG. 8
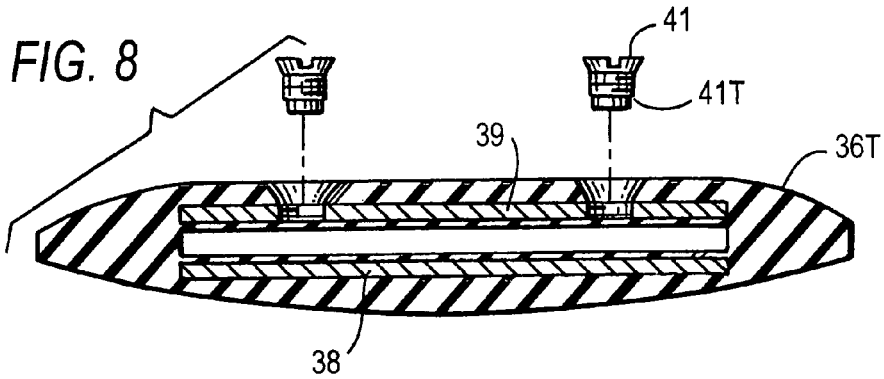
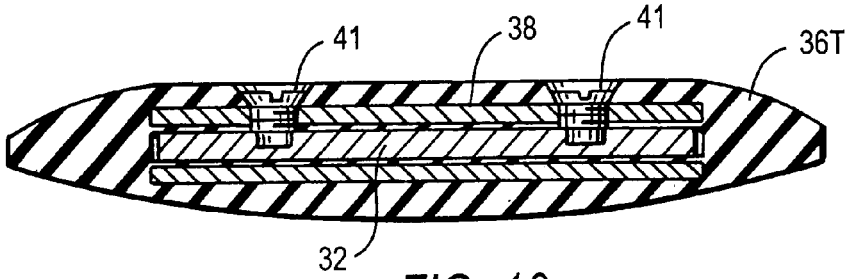
FIG. 10

FIG. 13
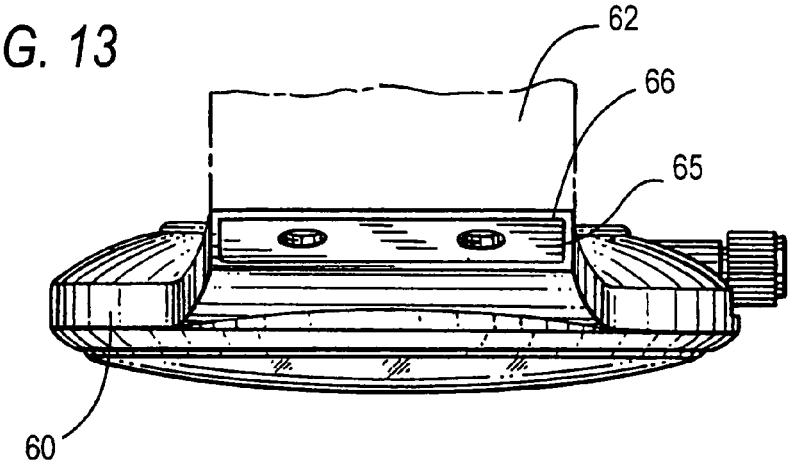
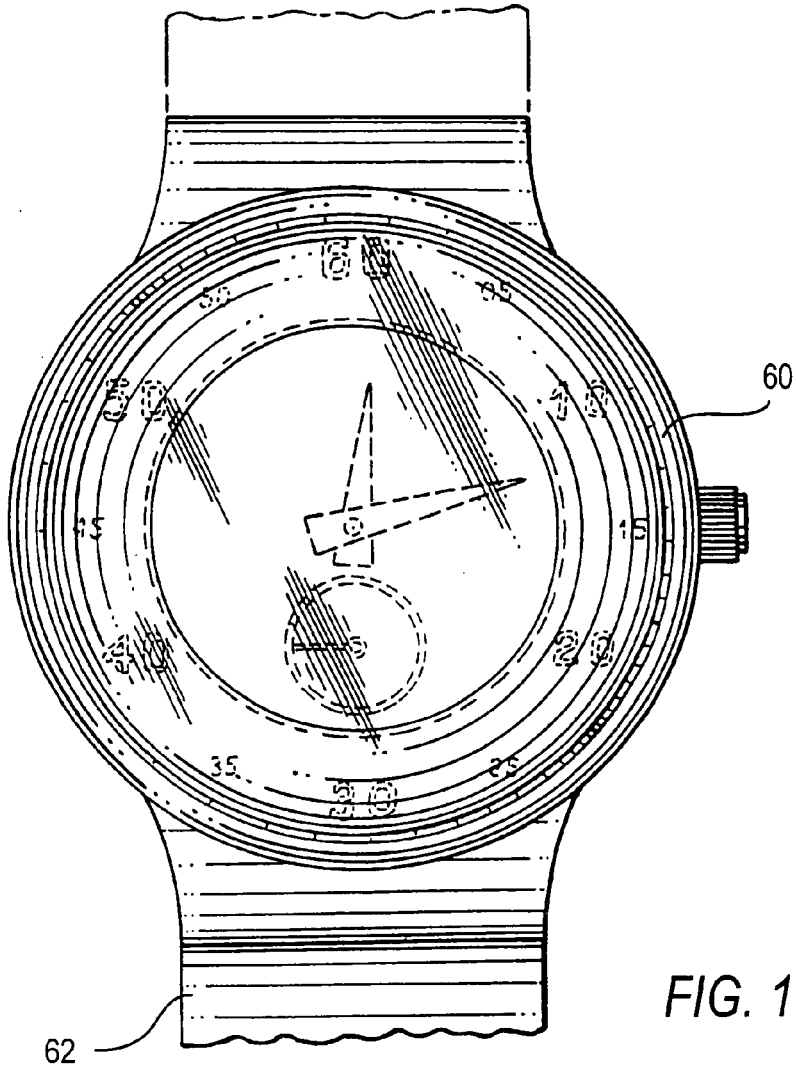
FIG. 14

FIG. 17
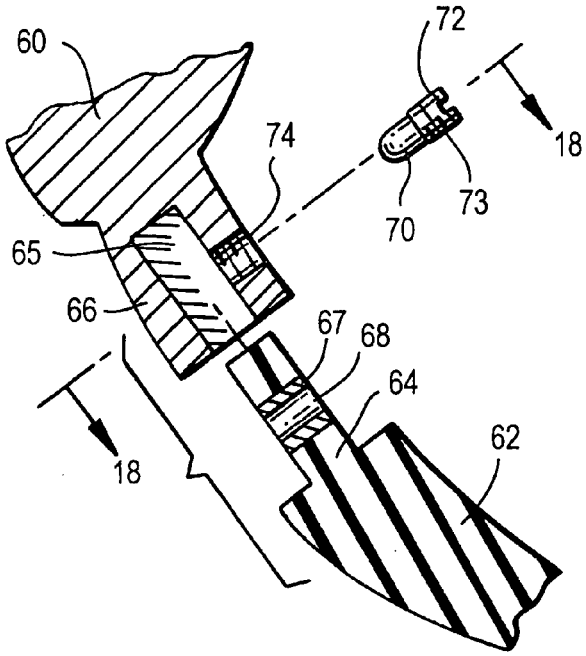
FIG. 19
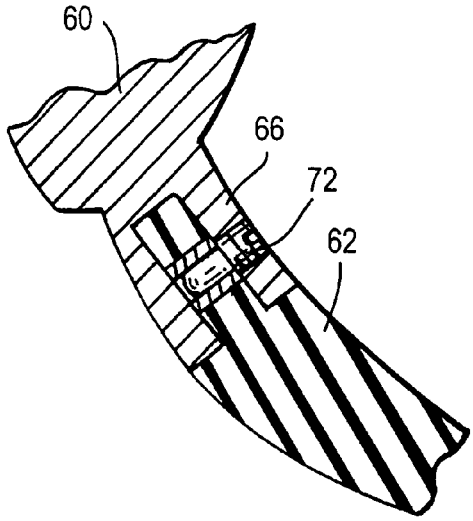
FIG. 18
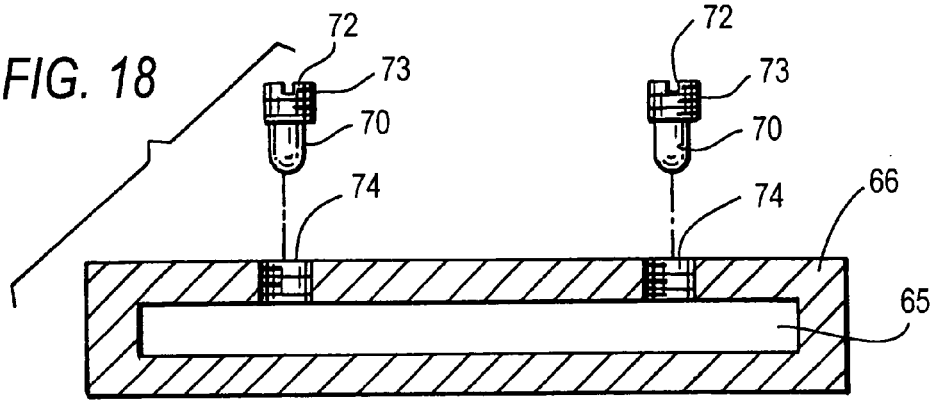
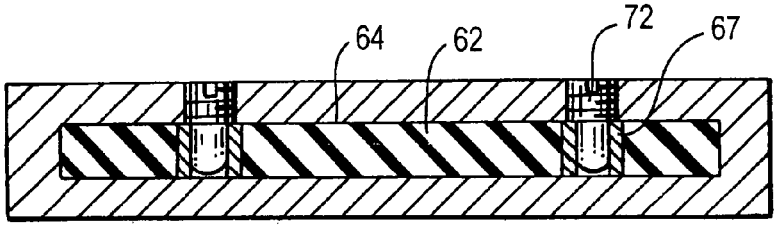
FIG. 20

WRISTWATCH AND COUPLING ASSEMBLY FOR RELEASABLY JOINING A WRISTWATCH CASE TO A WRISTBAND

BACKGROUND OF THE INVENTION

1. Field of the Invention

This invention is in the field of wristwatches and wristbands and coupling assemblies for releasably joining wristbands to wristwatch cases.

2. Prior Art

In the field of wristwatches and wristbands there are a great many different coupling assemblies for releasably joining wristbands to wristwatches. Such releasable couplings are provided for a variety of reasons, a first being to allow easy detachment and replacement of worn or damaged wristbands, and a second being to allow designers and the ultimate consumers a wide choice of wristbands as regards design, quality and comfort. Known wristbands, also called bracelets, are made of leather, rubber, plastic, metal or combinations thereof, and known coupling elements usually include metal or plastic components. One of the most common of these coupling assemblies includes at the top and bottom of the wristwatch casing, a pair of spaced-apart lugs with a spring-pin extending between these lugs, and means for securing each end of the wristband to one of these spring-pins. While the design styles of wristwatch casings and watchfaces may be elegant, whimsical, modern, traditional, abstract or rugged, extension of these design aspects to coupling assemblies has been difficult and often expensive because the functional requirement usually override artistic consideration.

In all these wristwatch/wristband structures, it is preferred that the coupling elements on the wristwatch case and on the wristband be reasonably easy to couple and uncouple and be strong, flexible and reliable when coupled. An additional very important object in creating these couplings, is to coordinate the styles of the coupling elements, the housings and the wristbands for the optimum aesthetic appearance. To achieve these multiple objectives, namely, ease of coupling and uncoupling, reliability and aesthetics, all in a single coupling assembly, has been a difficult problem for wristwatch designers for many years.

There has always been a problem of the coupling elements not being consistent with the artistry achieved in the design of the watchcasings and the wristbands or bracelets themselves. Common hinge elements, pins and screws and so forth tend to protrude from surfaces which are otherwise graceful and smooth and part of an overall wristwatch casing structure. Hinge elements are thus inconsistent with most watchface designs and casings and even with most wristwatch bracelets and wristbands. Certain clever and creative designers have found ways to cause the coupling elements to appear to be similar to elements of the wristband, such as to appear as similar links in the otherwise flexible and pivotal links in a flexible bracelet. This takes considerable effort, not only to design but to manufacture and implement, and typically results in a substantially increased cost to the consumer.

The present invention provides a new coupling assembly for releasably joining wristband elements to a watch casing. This invention achieves a simple, strong, reliable and relatively inexpensive junction with no sacrifice to the design impression of the watch casing. Of many possible embodiments of this invention, two preferred embodiments of it are disclosed herein, each having a projecting element extending from either the casing or from the wristband and thence into a slot in the other component, and in both embodiments the coupling components become essentially hidden, with the wristband appearing to be seamlessly attached to the casing or to be an extension of the casing, without any observable connecting means.

SUMMARY OF THE NEW INVENTION

This invention is a new coupling means for attaching top and bottom wristband components to the top and bottom portions of a wristwatch casing. This connection is done in a manner where the coupling elements are substantially invisible so that the wristband appears to be seamlessly attached to the casing. Seamless in this situation does not necessarily mean that there is no line of demarcation between the wristband and the casing; instead, seamless means that when the wristwatch is being worn, there is no evidence of how the wristband is attached. The wristband appears to simply extend from the case.

In addition to this above mentioned appearance factor, the new invention provides a very simple and economic structure for achieving this coupling. Furthermore, initial assembly or subsequent repair or simple interchanging of wristbands can be done in a very quick, easy, simple and reliable manner. More particularly, removing and replacing a wristband can be done easily by anyone with a tiny screwdriver, and there is no need to manipulate hard-to-reach spring elements, which often require the skill and special tools of a jeweler or other expert in this field.

It is an object of this invention to provide a wristwatch case and band combination where the watchcase has top and bottom parts, each part having an end face of predetermined periphery, and each of the wristband end faces has essentially the same periphery as that of the wristwatch case end faces. Thus, when each wristband end face is joined to a case end face, the junction is substantially smooth, and the longitudinal contours of the case and band may appear as generally continuous and uninterrupted.

It is a further object of this invention to provide a coupling assembly for joining said end faces of said wristband and said watchcase, where the coupling elements are essentially invisible when these end faces are joined. This is accomplished in one embodiment of this invention by providing a projection from the case end face that is smaller in perimeter than said end face, and providing a recess in the end face of the wristband that is also smaller in perimeter than the wristband end face. Thus, when the wristband and case end faces having the same perimeters are joined, the projection and recess coupling elements will not be visible.

It is a still further object to form the wristband of flexible rubber material, and to form the casing of ultra light weight and strong titanium.

A first preferred embodiment of the present wristwatch invention comprises:

a. a wristwatch case including a front watchface, an opposite rear wall, top and bottom parts and a watch movement within said case, b. a wristband comprising top-to-bottom band segments, each band segment being an elongated strip extending lengthwise in the top-to-bottom direction and having a first end part for engagement to said case and an opposite end part for engagement to said other band segment, and c. top and bottom coupling assemblies for releasably connecting said top and bottom parts of said case respectively to said top and bottom band segments, d. said top coupling assembly comprising:

i. an upper projection extending from said case top part, ii. a recess formed in said first end part of said top band segment and defined by top, bottom and side walls, said upper projection having height, width and depth dimensions adapted to fit into said recess, whereby said upper projection is essentially totally encompassed by said recess and invisible therein, and iii. axial connecting means adapted to engage and releasably join said first end part of said top band segment and said case top part, iv. said bottom coupling assembly, similar to said top coupling assembly, comprising a bottom projection extending from said case bottom part and insertable into and invisible within a recess in said first end part of said bottom band segment, and axial connecting means adapted to engage and releasably join said bottom projection and said bottom band segment part.

In this preferred embodiment the upper projection of the top coupling assembly is a thin blade, and said recess is defined by an elongated metal insert of U-shaped cross-section which is embedded in the end part of said top band segment.

The slot between the upper and lower walls of the insert receives the projection extending from the wristwatch case, and one or more set screws extend threadedly through the metal insert wall of the top band segment and protrude into an aligned recess in the projection.

The second preferred embodiment disclosed herein, achieves a similar result of a hidden coupling assembly which does not detract from the desired aesthetics of the wristwatch case and wristband combination. In this second embodiment a slot is formed in the top part of the case, and a mating projection extends from the exposed end of the wristband segment. As noted earlier, in each of these embodiments the wristwatch case has similar top and bottom parts that are releasably attachable to top and bottom wristband segments respectively.

A further preferred embodiment is a wristwatch case and wristband combination comprising:

a. a wristwatch case having top and bottom ends, b. a wristband having opposite ends which are connectible respectively to said top and bottom ends of said case, c. each of said top and bottom case ends, when cut by a transverse plane, defining an end face having a circumferential profile surrounding an area, d. each wristband end, when joined to said case and cut by said transverse plane, defining an end face having substantially the same circumferential profile and surrounded area as said case end face, and e. a coupling assembly for releasably joining each of said case end faces to one of said wristband end faces, each coupling assembly comprising:

i. a projection extending lengthwise from said case end face, said projection, when cut by said transverse plane, occupying a smaller circumference and area than that of said end face, ii. a recess in said wristband end face for receiving said projection, said recess forming an opening in said wristband end face defining area less than that of said wristband end face, said projection having dimensions adapted to fit into said recess, and iii. screw means adapted to engage said wristband end and said projection therein, whereby said projection and recess of said coupling means are essentially not visible when said wristband and case ends are joined.

A still further preferred embodiment is a wristwatch case and wristband combination comprising:

a. a wristwatch case having top and bottom ends, b. a wristband having opposite ends which are connectible respectively to said top and bottom ends of said case, c. each of said top and bottom case ends defining an end face, d. each wristband end defining an end face having substantially the same circumferential profile and surrounded area as said case end face, and e. a coupling assembly for releasably joining each of said case end faces to one of said wristband end faces, with the same circumferential profiles of said case and wristband coinciding, each coupling assembly comprising:

i. a projection extending lengthwise from said case end face, said projection, when cut by said transverse plane, occupying a smaller circumference and area end face, ii. a recess in said wristband end face for receiving said projection, said recess forming an opening in said wristband end face defining area less than that of said wristband end face, said projection having dimensions adapted to fit into said recess, and iii. screw means adapted to engage said wristband end and said projection therein, whereby said projection and recess of said coupling means are essentially not visible when said wristband and case ends are joined.

The above is intended merely as a summary of various inventive aspects presented in the present application and is in no way intended to be an exhaustive or all-inclusive recitation of such aspects. Additional aspects, forms, features and embodiments of the present invention will be further described below with regard to the preferred embodiments and shown in the accompanying drawings, in which:

BRIEF DESCRIPTION OF THE DRAWINGS

FIG. 3 is a top plan view thereof, FIG. 4 is a front view thereof, FIG. 7 is a fragmentary exploded view, partially in section, of the coupling assembly joining the watchcase and the wristband, FIG. 8 is a sectional view taken along line 8-8 in FIG. 7, showing the projection-receiving slot in the wristband, FIG. 9 is a fragmentary non-exploded view corresponding to FIG. 7 and showing the watchcase and wristband coupled together, FIG. 10 is a sectional view similar to FIG. 8, showing the watchcase and wristband coupled together, FIG. 13 is a top plan view thereof, FIG. 14 is a front view thereof, FIG. 17 is a fragmentary exploded view, partially in section, of the coupling assembly joining the watchcase and the wristband, FIG. 18 is a sectional view taken along line 18-18 in FIG. 17, showing the projection-receiving slot in the watchcase, FIG. 19 is a fragmentary non-exploded view corresponding to FIG. 17 and showing the watchcase and wristband coupled together, and FIG. 20 is a sectional view similar to FIG. 18, showing the watchcase and wristband coupled together.

DETAILED DESCRIPTION OF THE PREFERRED EMBODIMENTS

Figures 1, 2:
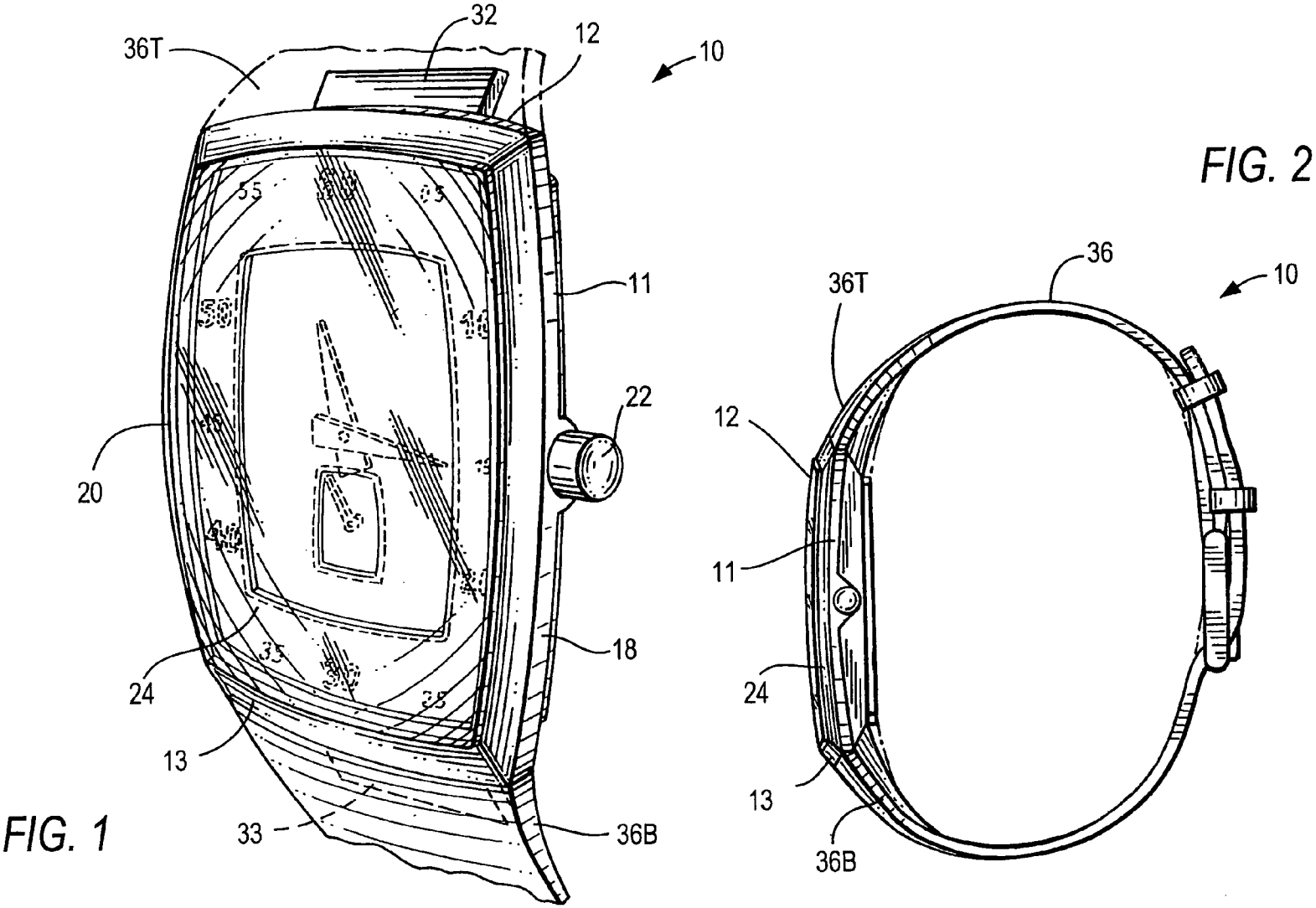
FIG. 1 is a fragmentary front and right side perspective view of a first embodiment of the new wristwatch and wristband coupling invention.
FIG. 2 is a right side elevation view thereof.

FIGS. 1-10 illustrate a first embodiment 10 of the new wristwatch, wristband 31 and coupling assemblies 14,15, and FIGS. 11-20 illustrate a second embodiment thereof. The first embodiment 10, as seen in FIGS. 1-6, includes wristwatch case 11 having top and bottom Parts 12,13 extending in the lengthwise direction, wristband top and bottom band segments 14,15; and top and bottom coupling assemblies 16,17 for releasably joining said top and bottom parts 12,13 of said case to said top and bottom band segments, 14,15 respectively. Said case 11 further includes right side part 18, left side part 20 with adjustment knob 22 in right side part 18, transparent crystal 24 and watchface 26 with the time indicating indicia thereon including the hour and minute hands 28,30 respectively.

At the top part 12 of casing 11 is an upper projection 32 which includes a recess 33, opening in the lengthwise and downward direction. The structure and coupling function of wristwatch case top part 12 with wristband top part 14T is typical for both the top and bottom coupling assemblies, and thus only the top coupling will be described. Top part 14T of the case includes upper projection 32 which has on its bottom surface 32S a small recess 33R. Top part 36T of wristband 36 includes in its distal end a slot 36S having dimensions suitable for receiving said projection 32. Slot 36S is defined by an elongated metal insert 38 formed as a channel having a generally U-shape cross-section, which is molded into and integral with the rubber or plastic wristband top segment 36T. Insert 38 has a bottom wall 39 which includes threaded holes 40 for receiving screws 41.

FIGS. 7-10 illustrate how upper projection 32 of case 12 is inserted into slot 36S until recesses 32R in projection 32 are aligned with threaded holes 40 in wristband top segment 36T. At this time set screws 41 may be driven axially until screw tips 41T enter recesses 32R, thereby coupling case 12 to the wristband 36. Screws 41, when inserted, may be locked in place by a variety of means, including friction of tip 41T in recess 32R or friction of the screw head with the insert 38.

Figure 6:
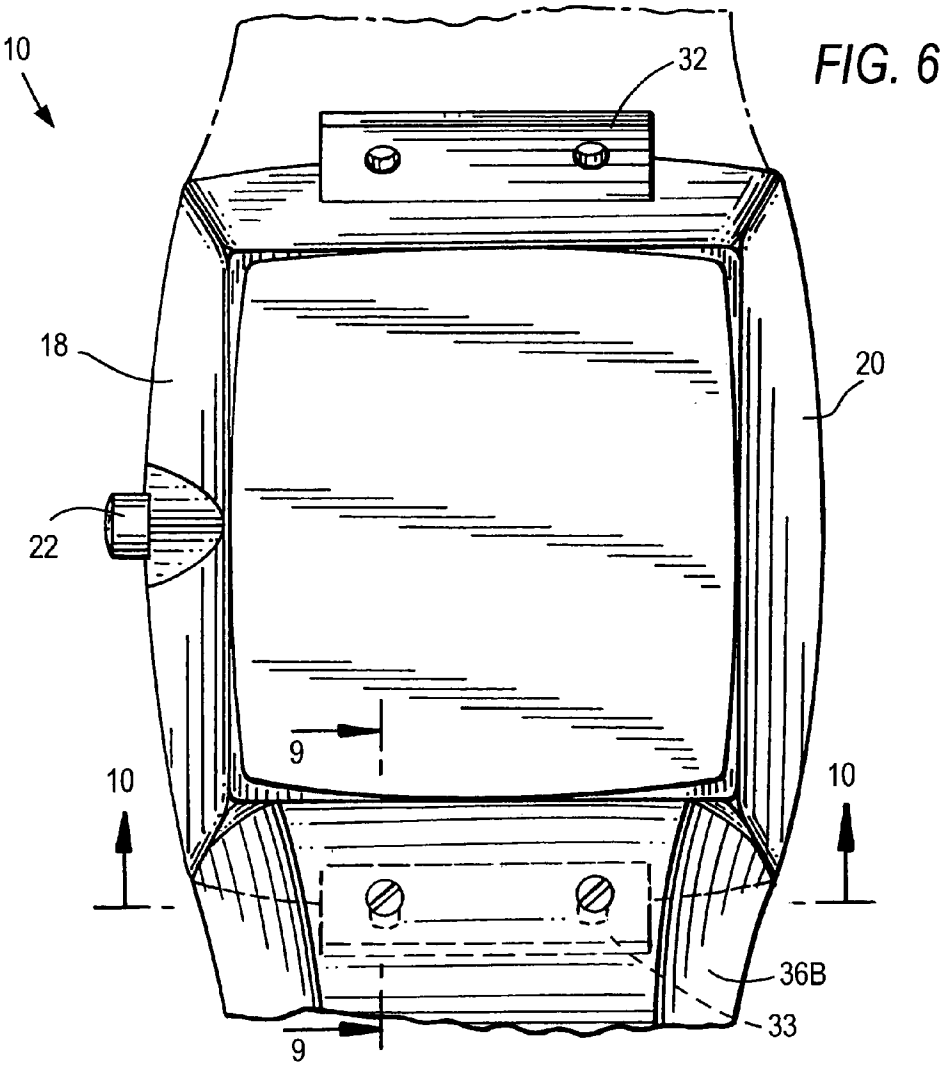
FIG. 6 is a rear elevation view thereof.
Figure 5:
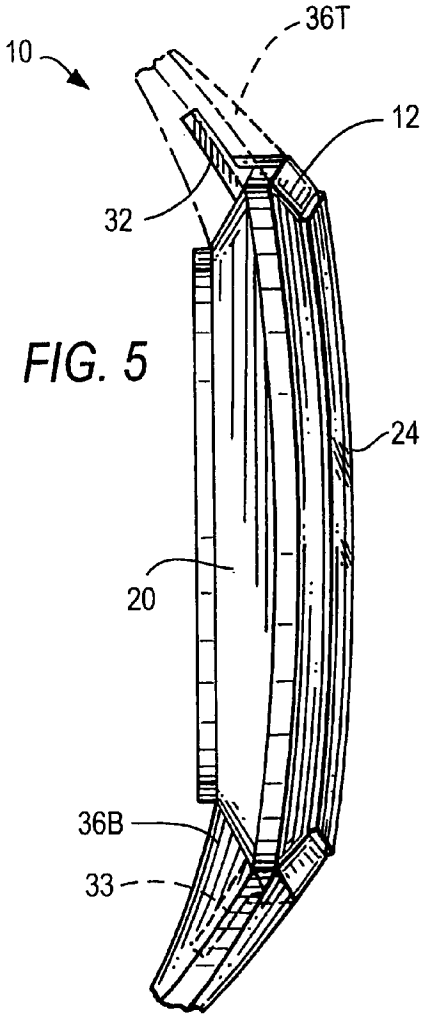
FIG. 5 is a left side elevation view thereof.
Figure 12:
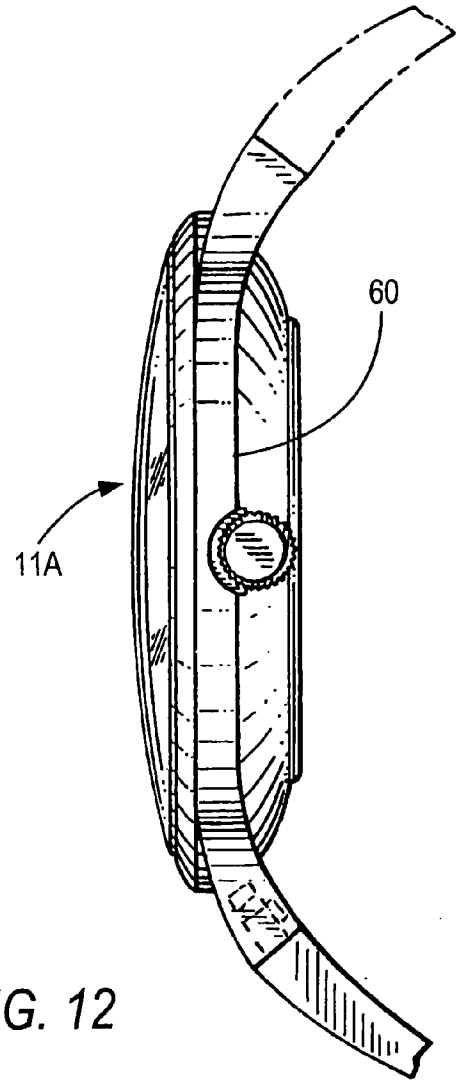
FIG. 12 is a right side elevation view thereof.
Figure 11:
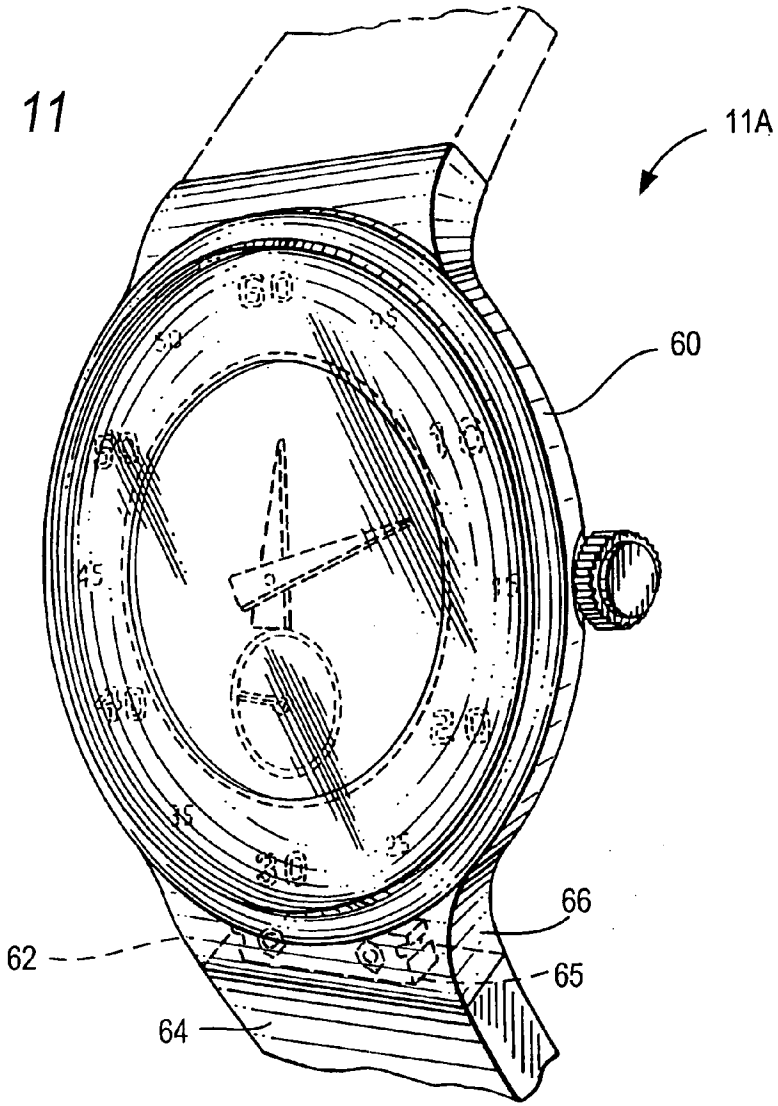
FIG. 11 is a fragmentary front and right side perspective view of a second embodiment of the new wristwatch and wristband coupling invention.
Figure 16:
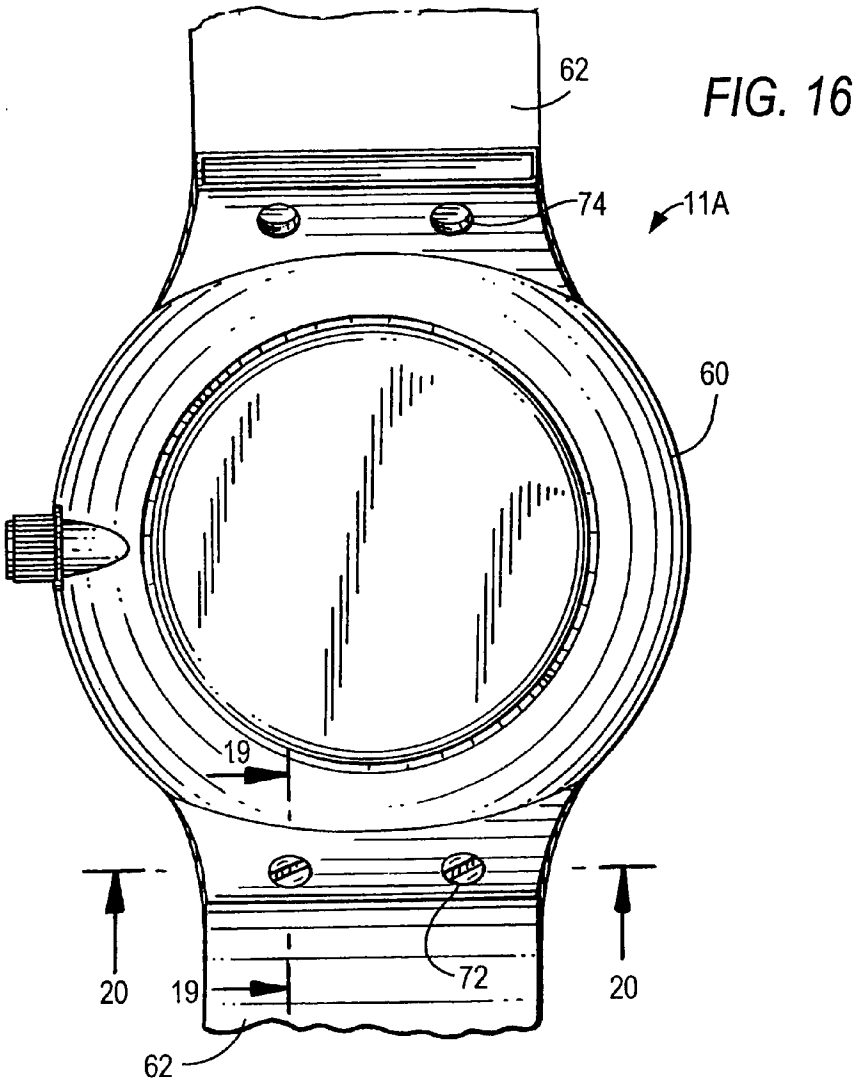
FIG. 16 is a rear elevation view thereof.
Figure 15:
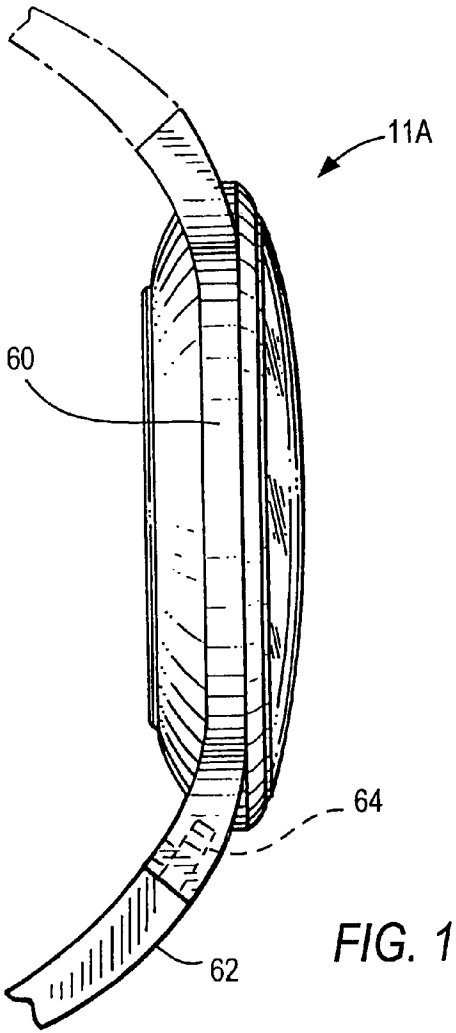
FIG. 15 is a left side elevation view thereof.

FIGS. 5, 6 and 9 illustrate how projection 32 is totally hidden on all six sides by slot 36S, such that the resulting coupling is essentially invisible, except for the tiny screws 41, which are, in fact, about three-times smaller than they appear in the enlarged drawing in FIG. 6. Thus, the slotted end 36T of the wristband 36 essentially totally encompasses projection 32. Furthermore, with this coupling, the wristband follows the contours of the watchcase as viewed from the front and sides, and thus aesthetically matches, complements and enhances the watch case shape.

Another advantage of this new structure includes elimination of the exposed hinge pin assembly of prior art wristwatches, which become dirty and require periodic cleaning, and which are usually different and not aesthetically consistent with the case style.

For coupling of wristwatch case top part 14 with wristband top band segment 36T, FIGS. 7 and 8 show how projection 32 extends into slot 36S, and then, as described above, the tip end 41T of the screw 41 extends through hole 40 and thence into recess 32R, whereby it securely locks the end of projection 32 into the slot 36S of the wristband segment.

FIGS. 11 through 20 illustrate the second preferred embodiment 11A of the present invention, which has similarities to the first embodiment 10, but essentially reverses the projection of each coupling element to now extend from the case into a slot or recess in the wristband, instead of the projection extending from the wristband into a recess in the case. More particularly, as seen in FIGS. 11, 12 and 17-20, the wristband upper segment 62 has a projection 64 which is inserted into slot or recess 65 within a projecting upper part 66 of watchcase 60. As seen in FIGS. 17, 19 and 20, there is a cylindrical, metal collar or sleeve 67 extending in a front-to-rear direction through projection 64. Collar 67 has a central bore 68 for receiving the distal end 70 of screw 72. The threaded proximal part 73 of screw 72 threadedly engages hole 74 in projecting part 66 of case 60.

The present invention has been described in connection with the preferred embodiments. One of ordinary skill will be able to effect various alterations, substitutions of equivalents and other changes without departing from the broad concepts imparted herein. It is, therefore, intended that the patent issued hereon be limited only by the definition contained in the appended claims and equivalents thereof.

The invention claimed is:

1. A wristwatch case and wristband combination, comprising:

a. a wristwatch case including opposite front and rear walls, top and bottom parts and side edges, and b. a wristband comprising top and bottom band segments, each band segment being an elongated flexible strip having a first end part for engagement to said case and an opposite end part for engagement to said other band segment, each said first end parts comprising front, rear and side walls defining between them a recess opening and an insert of material harder than said flexible strip secured within said first end part and adjacent at least one of said front and rear walls defining said recess, and c. a top coupling assembly, comprising:

i. a projection for extending from said case top part, said projection having height, width and depth dimensions adapted to fit into said recess in said first end part of said top band segment, whereby said projection, when it is inserted into said recess, is essentially totally encompassed by said recess and invisible therein, and ii. connecting means adapted to extend transversely through at least one of said recess walls and at least partially through said insert adjacent thereto, to releaseably join said top projection and top band segment part, and d. a bottom coupling assembly, similar to said top coupling assembly, comprising a projection extending from said case bottom part and insertable into and invisible within a recess in said first end part of said bottom band segment, and connecting means adapted to releasably join said bottom projection and said bottom band segment part.

2. An apparatus according to claim 1 wherein said insert is U-shaped in cross-section, comprising front and rear panels respectively adjacent the inside facing surfaces of said front and rear walls defining said recess.

3. An apparatus according to claim 1 wherein said connecting means is a screw.

4. An apparatus according to claim 3 wherein said screw engages a threaded hole in said insert and thence extends into a clearance hole in said projection.

5. An apparatus according to claim 1 wherein said wristband comprises flexible rubber.

6. A wristwatch case and wristband combination, comprising:

a. a wristwatch case including opposite front and rear walls, top and bottom parts and side edges, and b. a wristband comprising top and bottom band segments, each band segment being an elongated flexible strip having a first end part for engagement to said case and an opposite end part for engagement to said other band segment, c. each said top and bottom parts pf said case comprising front, rear and side walls defining between them a recess opening and an insert of material harder than said flexible strip secured within said first end part and adjacent at least one of said front and rear walls defining said recess, and c. a top coupling assembly, comprising:

i. a projection for extending from said top band segment, said projection having height, width and depth dimensions adapted to fit into said recess in said case top part, whereby said projection, when it is inserted into said recess, is essentially totally encompassed by said recess and invisible therein, and ii. connecting means adapted to extend transversely through at least one of said recess walls and at least partially through said insert adjacent thereto, to releaseably join said case top part and said top band segment part, and d. a bottom coupling assembly, similar to said top coupling assembly, comprising a projection extending from said bottom band segment and insertable into and invisible within a recess in said case bottom part, and connecting means adapted to releasably join said case bottom part and said bottom band segment part.

7. A wristwatch case and wristband combination according to claim 6 wherein said wristband comprises flexible rubber.

8. A wristwatch case and wristband combination according to claim 6 wherein said connecting means is a screw.

9. A wristwatch comprising:

a. a wristwatch case including a front watch face and crystal, a rear wall, top and bottom parts and side edges, and a movement, b. a wristband comprising top and bottom band segments, each band segment being an elongated flexible strip having a first end part for engagement to said case and an opposite end part for engagement to said other band segment, each said first end parts comprising front, rear and side walls defining between them a recess opening and an insert of material harder than said flexible strip secured within said first end part and adjacent at least one of said front and rear walls defining said recess, and c. a top coupling assembly, comprising:

i. a projection for extending from said case top part, said projection having height, width and depth dimensions adapted to fit into said recess in said first end part of said top band segment, whereby said projection, when it is inserted into said recess, is essentially totally encompassed by said recess and invisible therein, and ii. connecting means adapted to extend transversely through at least one of said recess walls and at least partially through said insert adjacent thereto, to releaseably join said top projection and top band segment part, and d. a bottom coupling assembly, similar to said top coupling assembly, comprising a projection extending from said case bottom part and insertable into and invisible within a recess in said first end part of said bottom band segment, and connecting means adapted to releasably join said bottom projection and said bottom band segment part.

* * * * *